US011419362B2

(12) United States Patent
Brookbank et al.

(10) Patent No.: US 11,419,362 B2
(45) Date of Patent: Aug. 23, 2022

(54) INSERTABLE FILTER UNIT

(71) Applicant: British American Tobacco (Investments) Limited, London (GB)

(72) Inventors: Aaron Brookbank, London (GB); Richard Young, London (GB)

(73) Assignee: NICOVENTURES TRADING LIMITED, London (GB)

( * ) Notice: Subject to any disclaimer, the term of this patent is extended or adjusted under 35 U.S.C. 154(b) by 701 days.

(21) Appl. No.: 15/955,445

(22) Filed: Apr. 17, 2018

(65) Prior Publication Data

US 2018/0228208 A1 Aug. 16, 2018

Related U.S. Application Data

(63) Continuation of application No. 14/440,226, filed as application No. PCT/EP2013/077544 on Dec. 19, 2013, now Pat. No. 11,076,636.

(30) Foreign Application Priority Data

Dec. 21, 2012 (GB) ..... 1223159

(51) Int. Cl.
*A24D 3/04* (2006.01)
*A24D 3/02* (2006.01)

(52) U.S. Cl.
CPC ..... *A24D 3/04* (2013.01); *A24D 3/0291* (2013.01); *A24D 3/048* (2013.01)

(58) Field of Classification Search
None
See application file for complete search history.

(56) References Cited

U.S. PATENT DOCUMENTS

| | | | |
|---|---|---|---|
| 1,861,910 | A | 6/1932 | Vernon |
| 3,066,681 | A | 12/1962 | Cohn |
| 3,242,925 | A | 3/1966 | Sterne |
| 3,270,750 | A | 9/1966 | Campbell |
| 3,466,213 | A | 9/1969 | Panicci et al. |
| 3,637,447 | A | 1/1972 | Berger et al. |
| 4,023,576 | A | 5/1977 | Norman |
| 4,227,540 | A | 10/1980 | Edison |
| 4,856,540 | A | 8/1989 | Jansma |

(Continued)

FOREIGN PATENT DOCUMENTS

| | | | |
|---|---|---|---|
| CN | 102440437 | A | 5/2012 |
| DE | 58463 | C | 1/1891 |

(Continued)

OTHER PUBLICATIONS

JP Office Action dated May 19, 2020 re: Application No. 2017-078094, pp. 1-8, citing: U.S. Pat. No. 4,972,856 A, JP 2009-504175 A, WO 2011/0773114 A1, WO 2011/051115 A1, WO 2011/086751 A1.

(Continued)

*Primary Examiner* — Michael J Felton
(74) *Attorney, Agent, or Firm* — Cantor Colburn LLP

(57) ABSTRACT

An insertable filter unit for insertion into a smoking article filter having a recess, wherein the insertable filter unit includes an outer casing defining a cavity for storing a smoke modifying agent, and wherein the insertable filter unit is arranged to be inserted into the recess of the smoking article filter by a user.

13 Claims, 6 Drawing Sheets

(56) References Cited

U.S. PATENT DOCUMENTS

| | | | | |
|---|---|---|---|---|
| 4,972,856 | A * | 11/1990 | Sergio | A24D 1/045 131/227 |
| 5,144,967 | A | 9/1992 | Cartwright et al. | |
| 7,578,298 | B2 | 8/2009 | Karles et al. | |
| 2002/0148478 | A1 | 10/2002 | Pera | |
| 2004/0045566 | A1 | 3/2004 | Pera | |
| 2008/0216848 | A1 | 9/2008 | Li et al. | |
| 2012/0260928 | A1 | 10/2012 | Herholdt | |

FOREIGN PATENT DOCUMENTS

| | | | |
|---|---|---|---|
| DE | 1873551 | U1 | 6/1963 |
| EP | 0289243 | A1 | 11/1988 |
| FR | 2596252 | A1 | 10/1987 |
| GB | 440316 | A | 12/1935 |
| GB | 2203324 | A | 10/1988 |
| JP | 5145440 | A | 11/1976 |
| JP | 1037433 | Y2 | 7/1988 |
| JP | 03108472 | A | 5/1991 |
| JP | 07274925 | A | 10/1995 |
| JP | 11196844 | A | 7/1999 |
| JP | 3101573 | U | 6/2004 |
| JP | 2009504175 | A | 2/2009 |
| JP | 5164217 | B2 | 3/2013 |
| KR | 1020090110733 | A | 10/2009 |
| WO | 9201487 | A1 | 2/1992 |
| WO | 2006090290 | A1 | 8/2006 |
| WO | 2007123046 | A1 | 11/2007 |
| WO | 2008074977 | A1 | 6/2008 |
| WO | 2008081338 | A2 | 7/2008 |
| WO | 2008110934 | A2 | 9/2008 |
| WO | 2008150130 | A1 | 12/2008 |
| WO | 2009004490 | A2 | 1/2009 |
| WO | 2011051115 | A1 | 5/2011 |
| WO | 2011077314 | A1 | 6/2011 |
| WO | 2011086751 | | 7/2011 |

OTHER PUBLICATIONS

CN OA issued Jan. 3, 2018 re: Application No. 201380066502.8, pp. 1-21, citing: U.S. Pat. No. 4,972,856A, U.S. Pat. No. 4,023,576A, CN1060773A, US2004/0045566A1, U.S. Pat. No. 3,466,213A and U.S. Pat. No. 4,856,540A.

* cited by examiner

INSERTABLE FILTER UNIT

CROSS REFERENCE TO RELATED APPLICATIONS

This application is a continuation of U.S. patent application Ser. No. 14/440,226, filed May 1, 2015, which is the U.S. National Stage Entry of PCT Application No. PCT/EP2013/077544, filed Dec. 19, 2013, which in turn claims priority to United Kingdom Patent Application No. GB1223159.3, filed Dec. 21, 2012. The entire contents of the aforementioned applications are herein expressly incorporated by reference.

FIELD

The present invention relates to an insertable filter unit for a smoking article filter having a recess.

BACKGROUND

Cigarettes and other smoking articles contain a charge of tobacco which may be combusted to produce smoke which is inhaled by a user. Filters for smoking articles are used to filter the smoke resulting from the combustion of tobacco before it reaches the user's mouth. Filters known in the art for this purpose may be formed from a plug of fibrous cellulose acetate or other materials.

To enhance the removal of certain smoke constituents various additives may be added to smoking article filters. Examples include smoke adsorbents such as activated carbon which adsorbs certain smoke constituents thus removing them from the smoke stream passing through the filter.

In addition to removing constituents from smoke, filter additives may impart organoleptic characteristics to smoke passing through the filter. For example, fragrances and flavourants, where local regulations permit, may be incorporated which alter the aroma and taste characteristics of smoke that has passed through the filter.

Traditionally, smoking articles with filters incorporating the features described above are sold together in packs, with the smoking articles in each pack sharing the same flavours, fragrances and sorbent characteristics.

SUMMARY

The present invention provides an insertable filter unit for insertion into a smoking article filter having a recess, wherein the insertable filter unit comprises an outer casing defining a cavity for storing a smoke modifying agent, and wherein the insertable filter unit is arranged to be inserted into the recess of the smoking article filter by a user.

BRIEF DESCRIPTION OF THE DRAWINGS

So that the present invention may be fully understood, embodiments thereof will be described, by way of example only, with reference to the accompanying drawings, in which.

DETAILED DESCRIPTION

Figure 1:
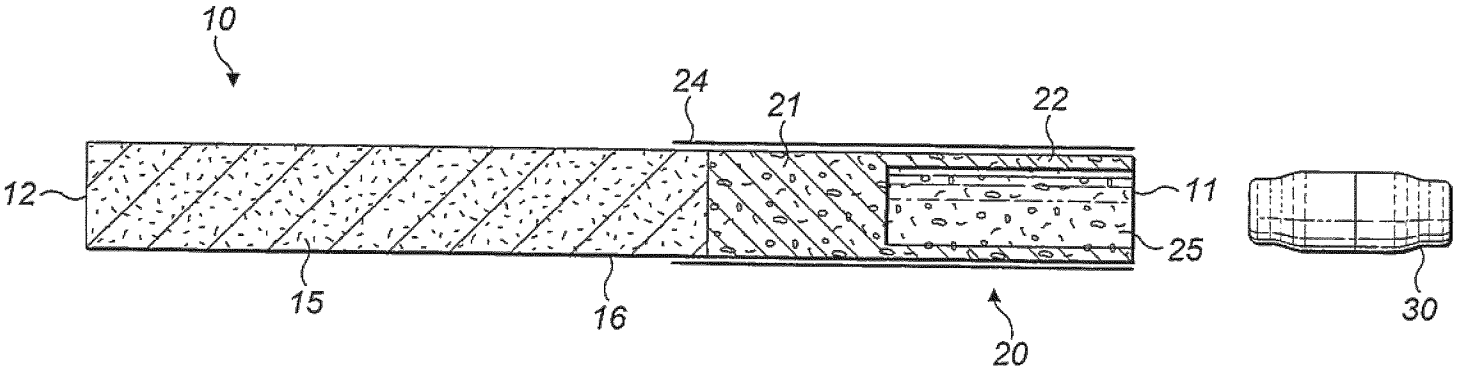
FIG. 1 is a side-on cross sectional view of a smoking article and insertable filter unit in accordance with a first embodiment.

FIG. 1 shows a smoking article 10 having a buccal end 11 and a distal end 12. The smoking article 10 comprises a tobacco rod 15 and a filter 20 attached thereto. The tobacco rod 15 is wrapped in tobacco wrapping paper 16.

Figure 2:
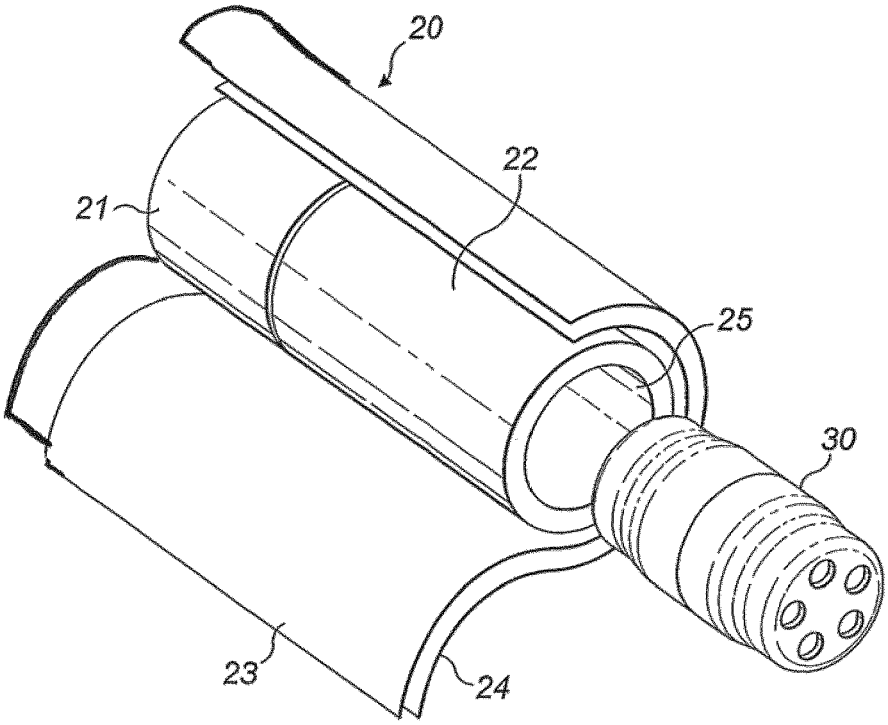
FIG. 2 is a perspective view of the filter and insertable filter unit shown in FIG. 1.

The filter 20 is shown in more detail in FIG. 2. The filter 20 comprises a cylindrical filtration region 21 and a tubular filtration region 22, which in use is downstream of the cylindrical filtration region 21 in relation to the direction of mainstream smoke drawn through the filter 20. The cylindrical filtration region and the tubular filtration region 22 may be formed from filtration material such as fibrous cellulose acetate or other suitable material known in the art.

The cylindrical filtration region 21 may be approximately 12 mm in length and the tubular filtration region 22 may be approximately 15 mm in length according to certain embodiments.

The filtration material of the cylindrical filtration region 21 and/or tubular filtration region 22 may be provided with an additive. For example, an adsorbent material such as activated carbon, which may be in bead, granule or thread form, may be provided. The additive may be added to the filtration material during filter production. For example, as filter tow is conveyed to a garniture, additive may be added thereto continuously to provide an additive dispersed throughout the filtration material. Alternatively, additive may be added in pulses to form sections within the filtration material containing additive.

Figure 3:
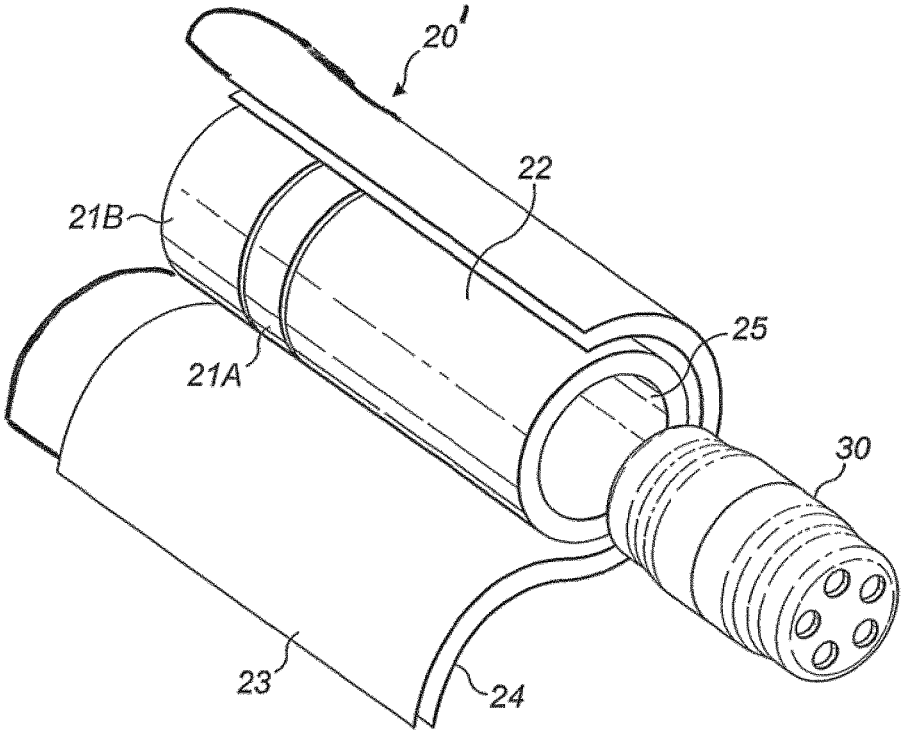
FIG. 3 is a perspective view of a filter and insertable filter unit according to a second embodiment.

The cylindrical region 21 and the tubular filtration region 22 may be wrapped in a plugwrap 23. The filter 20 may be attached to the tobacco rod 15 using tipping paper 24 which circumscribes the filter 20. The tipping paper 24 shown in FIGS. 1-3 is slightly longer than the filter 20 so that an overlap is formed when the tipping paper 24 is wrapped around the filter 20. This overlap may have some form of adhesive applied to the inner surface thereof which, in use, adheres to the outer surface of the tobacco wrapping paper 16. Other attachment means for attaching the filter 20 to the tobacco rod 15 that are known in the art may also be employed.

The filter 20 has a recess 25, defined by the cylindrical filtration region 21 and the tubular filtration region 22, the recess 25 extending from the buccal end 11 and arranged to accommodate a generally cylindrical insertable filter unit 30. The recess 25 extends at least along part of the length of the filter 20. The shape of the recess 25 may be designed to complement the shape of the insertable filter unit 30 to ensure a secure fit when the insertable filter unit 30 is inserted into the recess 25 of the filter 20. In the embodiments shown in FIGS. 1-3, the cylindrical insertable filter unit 30 complements in shape the hollow cylindrical shape of the recess 25. The dimensions, such as length and diameter of the recess 25 and the insertable filter unit 30 may be selected to complement each other. For example, an insertable filter unit 30 having a length of approximately 13 mm and a diameter of approximately 5 mm at its widest point may be inserted into a recess having a length of approximately 15 mm and a diameter slightly larger than 5 mm to allow a secure fit between the recess 25 and insertable filter unit 30.

An embodiment of a filter 20' containing an activated carbon section is shown in FIG. 3. In this embodiment the cylindrical section 21 comprises a region of filtration material 21A such as cellulose acetate and an activated carbon section 21B. The region of filtration material 21A may be approximately 5 mm in length and the activated carbon section 21B may be approximately 7 mm in length according to certain embodiments.

In use, the activated carbon section 21B removes certain particulate and/or vapour phase constituents from a smoke stream passing through the filter 20'. While activated carbon is effective in removing particulate and/or vapour phase constituents, it can also impart certain taste or aromatic qualities which may be undesired. The region of filtration material 21A, being located downstream of the activated carbon section 21B in use, prevents the activated carbon in the activated carbon section 21B from imparting unwanted organoleptic properties to material located downstream of the filtration material 21A.

Figure 4:
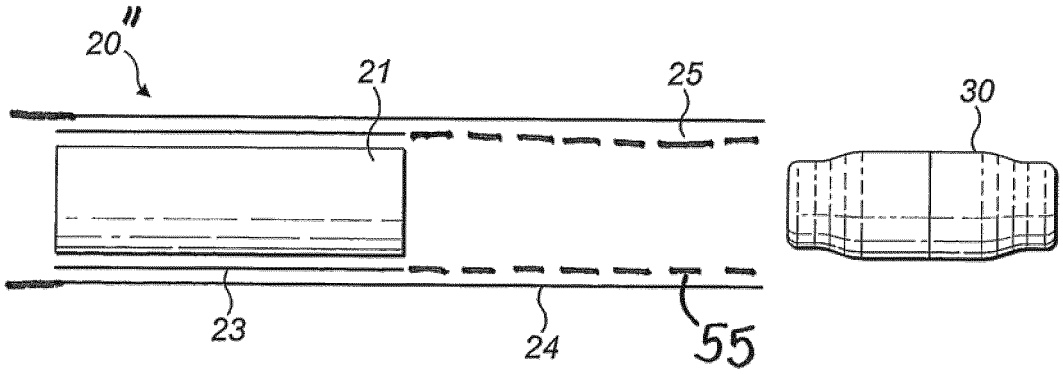
FIG. 4 is a side view of a filter and insertable filter unit according to a third embodiment.

FIG. 4 shows an alternative filter 20". In this embodiment the tipping paper 24 which wraps the cylindrical filtration material 21 is formed from a rigid card-like material which extends beyond the buccal end of the cylindrical filtration material 21 to form a recess 25 into which insertable filter units 30 may be inserted. In this embodiment, no tubular filtration region 22 is employed. The rigid card-like material may be a spirally wound cardboard tube. In alternative embodiments, a tipping paper 24 of conventional rigidity may be used and the recess 25 provided with an additional tube 55 formed from a rigid card-like material which is shown in FIG. 4 using dashed lines.

Figure 5:
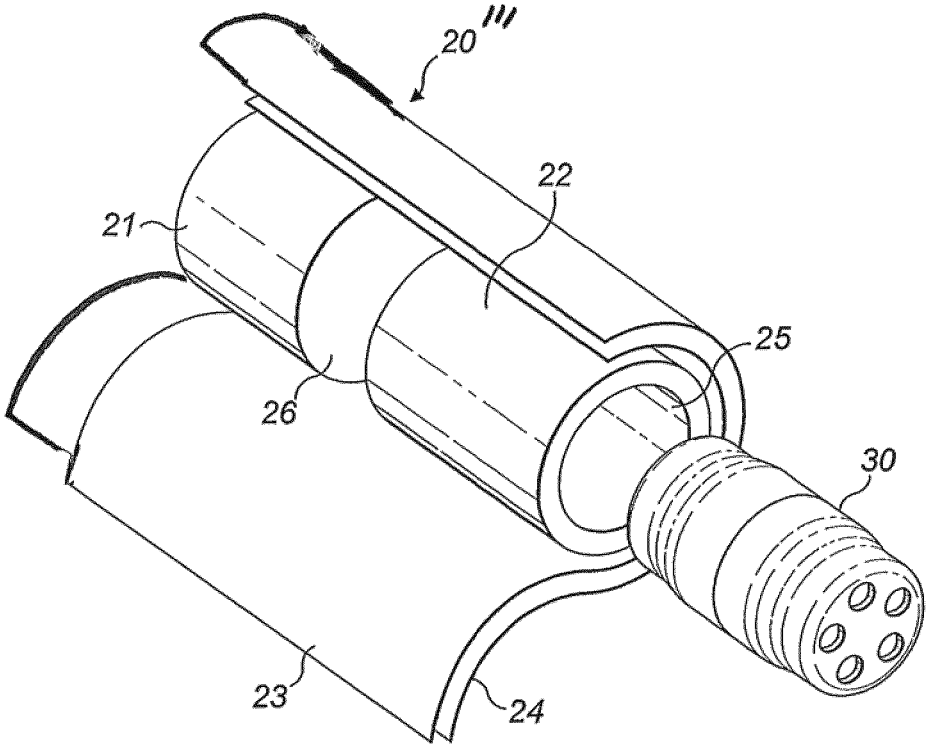
FIG. 5 is a perspective view of a filter and insertable filter unit according to a fourth embodiment.

FIG. 5 shows a filter 20'" and insertable filter unit 30 substantially similar to that described above with reference to FIGS. 1 and 2. However, this embodiment differs from that described above in that the tubular filtration region 22 is shorter in length than the tubular filtration region 22 shown in FIG. 2. A cylindrical gap 26 is thereby provided between the tubular filtration region 22 and the cylindrical filtration region 21 in this embodiment.

The insertable filter unit 30 of varying dimensions, such as length and diameter, may be used in conjunction with smoking articles of varying dimensions. Filters 20 and insertable filter units 30 may be used in conjunction with varieties of smoking articles with dimensions ranging from 'superslim' or 'demislim' to 'king size'—terms which are well known in the art.

The insertable filter unit 30 may contain an additive arranged to modify an organoleptic characteristic of smoke passing through the insertable filter unit 30 as the smoking article 10 is smoked by a user.

It should be understood that the smoking article 10 may equally be smoked with no insertable filter unit 30 inserted in the recess 25. The materials of the cylindrical filtration region 21 and tubular filtration region 22 are such as to provide a pressure drop that corresponds to the pressure drop of a conventional smoking article when a user draws on the buccal end 11 of the smoking article 10. The insertable filter unit 30 is arranged not to alter the pressure drop significantly when inserted into the recess 25 of the filter 20.

Figure 6:
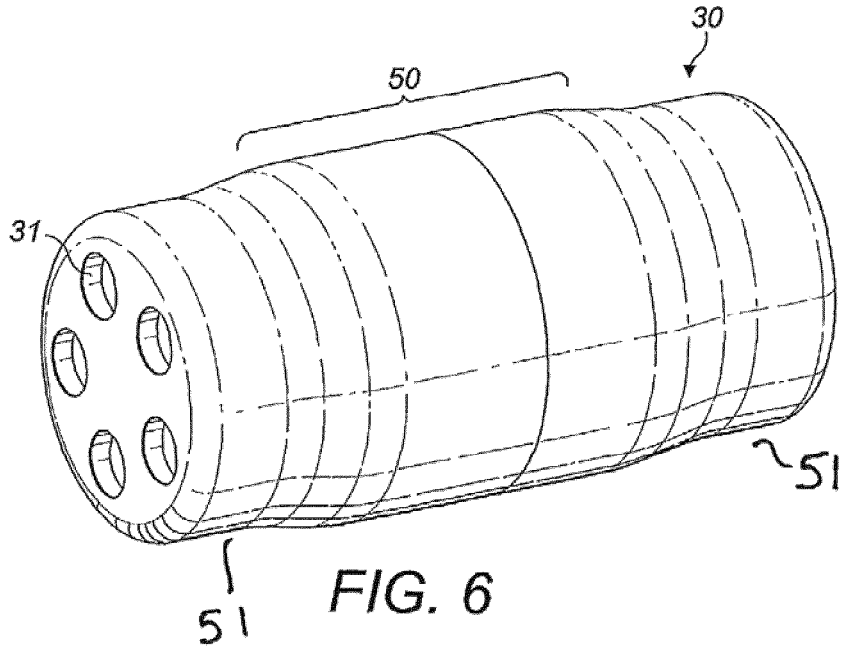
FIG. 6 is a perspective view of an insertable filter unit.

FIG. 6 shows a generally cylindrical closed end hollow insertable filter unit 30 in an assembled state according to one embodiment. The insertable filter unit 30 has a circular array of five holes 31 located in both ends thereof. In alternative embodiments, the insertable filter unit 30 may have a single hole or any suitable number of holes arranged in an array located in both ends of the insertable filter unit 30.

The insertable filter unit 30 may comprise one or more portions 50 having a first diameter and one or more portions 51 having a second diameter which is smaller than the first diameter. For instance, the insertable filter unit 30 may be provided with a central portion 50 and end portions 51 either side of the central portion 50 having a smaller diameter than the central portion 50. The smaller diameter of the end portions 51 allows a user to locate the end portion inside the recess 25. The user then continues to push the insertable filter unit 30 into the recess 25. The wider central portion 50 comes into contact with the tubular wall of the recess to form a secure fit between the recess and the insertable filter unit 30.

The contact between the insertable filter unit 30 and the recess 25 may produce a sensory indication such as an audible sound or a tactile feedback which a user feels as he inserts the filter unit 30 into the recess 25. As such, the user is given an indication that the insertable filter unit 30 has been fully inserted into the recess 25.

The insertable filter unit 30 may be approximately 13 mm in length when assembled, may have a major diameter of approximately 5.24 mm and may have a minor diameter of approximately 4.93 mm in one embodiment. Each of the plurality of holes 31 may have a diameter of approximately 1 mm. However, the skilled person will understand that such dimensions may be altered taking into account various considerations. For example, the length and diameter of the insertable filter unit 30 may vary depending on the dimensions of the filter 20 and recess 25 into which the insertable filter unit 30 is to be inserted. The diameter as well as number of holes may be varied depending on the contents of the insertable filter unit 30. Holes with a smaller diameter may be used for contents of small unit size to reduce the occurrence of unintended egression of the contents, while larger holes may be used for contents less liable to egress from the insertable filter unit 30 while the smoking article 10 is being smoked. The hole diameter may also be selected to enable a pressure drop consistent with the pressure drop experienced when smoking conventional smoking articles.

The insertable filter unit 30 may be formed by injection moulding and may be formed from a plastics material comprising a polyvinyl alcohol (PVOH) although other suitable materials may be used. Materials used to form the insertable filter unit 30 may be transparent, opaque or translucent. The insertable filter unit 30 may be coloured or plain. The insertable filter unit 30 may have printed features. Features may be added to the insertable filter unit 30 by embossing or debossing.

Figure 7:
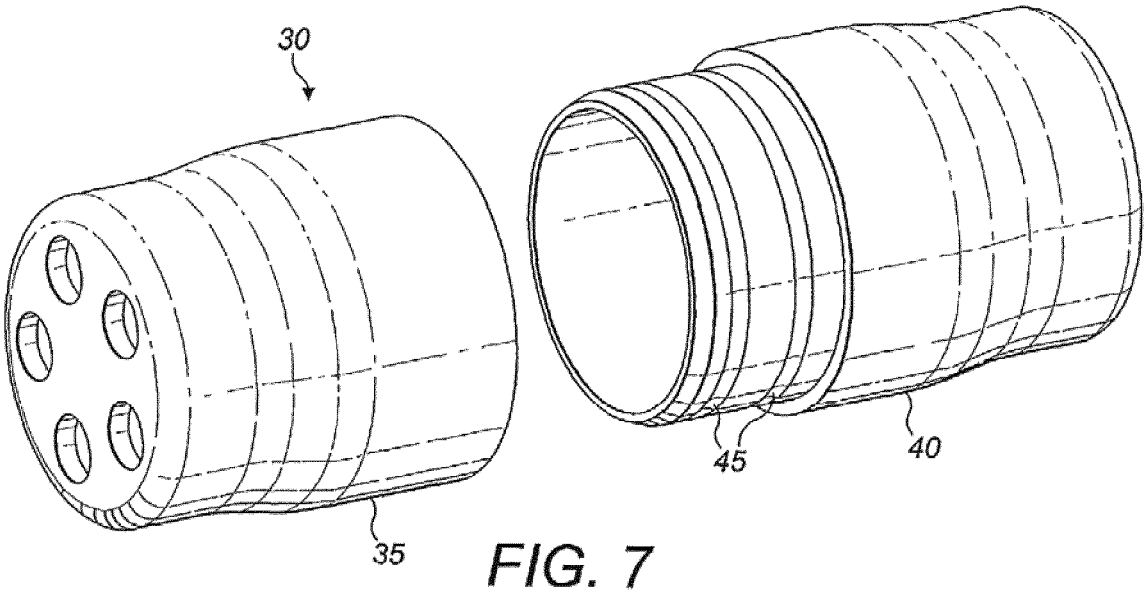
FIG. 7 is a perspective view of first and second parts of the insertable filter unit.

FIG. 7 shows the insertable filter unit 30 in a disassembled or unassembled state. The insertable filter unit 30 comprises a receiving portion 35 and an insertion portion 40 which are mutually engageable. The receiving portion 35 and insertion portion 40 are arranged so that the diameter of the engaging part of the receiving portion 35 is greater than the diameter of an engaging part of the insertion portion 40 so that an overlap may be formed between the receiving portion 35 and insertion portion 40 when the insertable filter unit 30 is assembled. The receiving portion 35 and the insertion portion 40 are both hollow so that, when assembled, the insertable filter unit 30 defines a cylindrical cavity 41 shown in FIG. 8.

Figure 9:
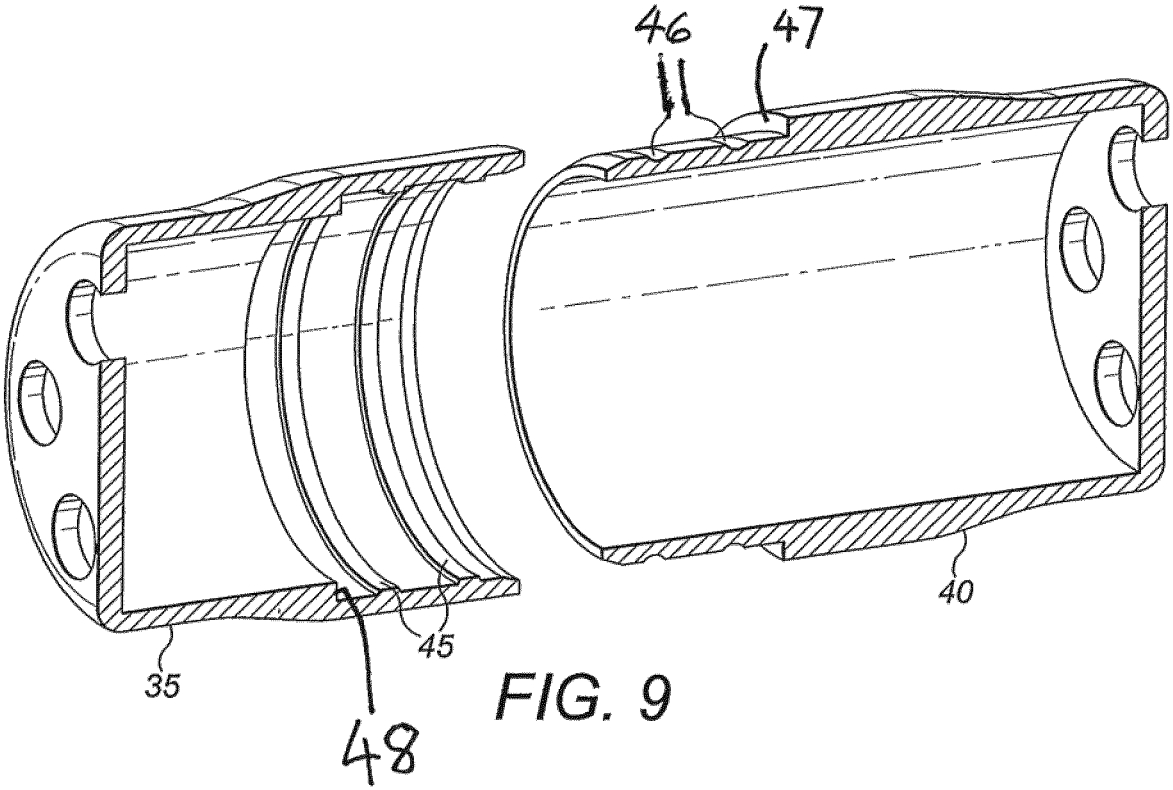
FIG. 9 is a cross sectional perspective view of the first and second parts of the insertable filter unit.

A cross sectional view of the insertable filter unit 30 in an unassembled or disassembled state is shown in FIG. 9. The receiving portion 35 is provided with a plurality of inner circumferential ridges 45 and the insertion portion 40 is provided with a plurality of cooperating outer circumferential depressions 46. The inner circumferential ridges 45 of the receiving portion 35 cooperate with the outer circumferential depressions 50 of the insertion portion 40 to facilitate the formation of an interference fit between the receiving portion 35 and the insertion portion 40 of the insertable filter unit 30 when the insertable filter unit 30 is assembled.

The insertable filter unit 30 is assembled by pushing together the receiving portion 35 and the insertion portion 40 so that the engaging part of the receiving portion 35 and the engaging part of the insertion portion 40 overlap. As the filter unit 30 is fully assembled the leading edge of the receiving portion 35 makes contact with a shoulder 47 of the insertion portion 40 and the inner circumferential ridges 45 engage with the outer circumferential depressions 46. Likewise, the leading edge of the insertion portion 40 makes contact with a shoulder 48 of the receiving portion 35 upon full assembly of the insertable filter unit 30. This engagement may produce an audible sound and tactile feedback to a user. Such a sensory indication indicates to a user that the insertable filter unit 30 has been assembled.

Figure 8:
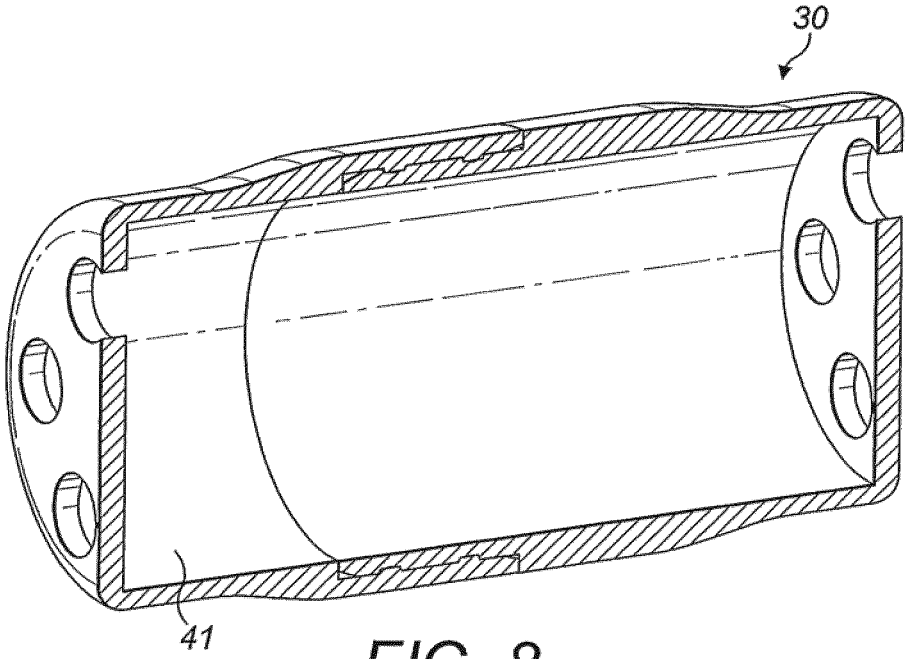
FIG. 8 is a cross sectional perspective view of the insertable filter unit.

FIG. 8 shows a cross section of the insertable filter unit 30 when assembled. The insertable filter unit 30 defines a cavity 41 suitable for holding a smoke modifying agent.

The smoke modifying agent may comprise a tobacco industry product such as tobacco, laminar tobacco, a tobacco derivative, expanded tobacco, reconstituted tobacco, a tobacco substitute or a non-smoking product incorporating tobacco, a tobacco derivative, expanded tobacco, reconstituted tobacco or tobacco substitutes.

The smoke modifying agent may comprise a flavourant such as mint or coffee. The flavourant may be provided in botanical form.

The smoke modifying agent may comprise a sorbent such as activated carbon or fibrous filtration material used in the tobacco industry such as cellulose acetate.

In some embodiments, the cavity 41 contains tobacco. The tobacco may be processed in a manner substantially similar to that known in the art for forming tobacco rods for cigarettes. As the tobacco is conveyed in a stream it is cut into portions having a predetermined size to correspond with the dimensions of the cavity 41 in order to fit inside. This has the advantage that tobacco used in insertable filter units 30 may be processed using existing tobacco processing methods with only a slight degree of modification.

The insertable filter unit 30 may be provided to a user separately from the smoking article 10 into which the insertable filter unit 30 is to be inserted. Prior to smoking the smoking article 10, the user may insert the insertable filter unit 30 into the filter 20 of the smoking article 10.

Alternatively, the smoking article 10 may be provided to the user with the insertable filter unit 30 already inserted therein.

In any case, the insertable filter unit 30 is inserted into the recess 25 of the filter 20 after formation of the filter 20. An advantage of providing an insertable filter unit 30 is that the insertable filter unit 30 can contain any of a wide variety of smoke modifying agents so that smoking articles with a variety of characteristics, such as flavour and sorbent content, may be provided without modifying the production of the smoking article itself.

Figure 10:
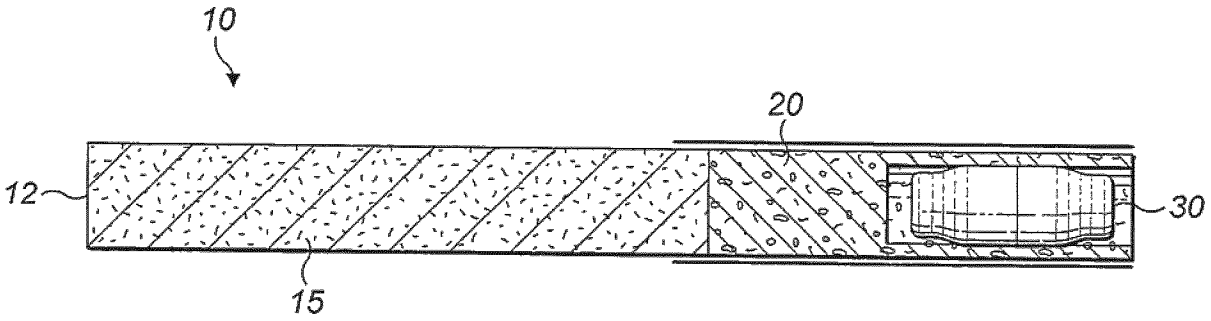
FIG. 10 is a side-on cross sectional view of an insertable filter unit inserted in a smoking article.

FIG. 10 shows a smoking article 10 with an insertable filter unit 30 inserted therein. The user may then light the distal end 12 of the tobacco rod 15 and smoke the smoking article 10 in a conventional way. Smoke passes through the filter 20 and into the insertable filter unit 30 through the holes 31 situated in the distal end. An organoleptic quality of the smoke may be modified by the contents of the insertable filter unit 30. The smoke may pass through holes at the buccal end of the insertable filter unit 30 and into the user's mouth.

As used herein, the terms "flavour" and "flavourant" refer to materials which, where local regulations permit, may be used to create a desired taste or aroma in a product for adult consumers. They may include extracts, flavour enhancers, bitterness receptor site blockers, sensorial receptor site activators or stimulators, sugars and/or sugar substitutes, and other additives such as charcoal, chlorophyll, minerals, botanicals, or breath freshening agents. They may be imitation, synthetic or natural ingredients or blends thereof. They may be in any suitable form, for example, oil, liquid, or powder.

In order to address various issues and advance the art, the entirety of this disclosure shows by way of illustration various embodiments in which the claimed invention(s) may be practised and provide for superior insertable filter units. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. An insertable filter unit for insertion into smoking article filter having a recess, wherein the insertable filter unit contains a tobacco industry product, wherein the insertable filter unit comprises an outer casing defining a cavity for storing the tobacco industry product, wherein the outer casing comprises a receiving portion and an insertion portion;

wherein the receiving portion and the insertion portion are mutually engageable parts that, when assembled by pushing together the receiving portion and the insertion portion in an axial direction, define the cavity;

wherein the insertable filter unit is arranged to be inserted into the recess of the smoking article filter by a user, and comprises a central portion and end portions either side of the central portion, the diameter of the end portions being smaller than the diameter of the central portion, and wherein the tobacco industry product comprises tobacco, laminar tobacco, a tobacco derivative, expanded tobacco, or reconstituted tobacco.

2. An insertable filter unit according to claim 1, wherein the insertable filter unit comprises a plurality of apertures therein to allow aerosol to travel through the insertable filter unit in a generally axial direction.

3. An insertable filter unit according to claim 2, wherein the plurality of apertures comprises at least one aperture disposed in a flat end of the insertable filter unit.

4. An insertable filter unit according to claim 1, comprising a plurality of apertures in a first end of the insertable filter unit and a plurality of apertures in a second end of the insertable filter unit.

5. An insertable filter unit according to claim 1, wherein the insertable filter unit contains fibrous filtration material.

6. An insertable filter unit according to claim 1, formed by injection moulding.

7. An insertable filter unit according to claim 1, formed from a plastics material.

8. A smoking article filter comprising a recess arranged to accommodate an insertable filter unit according to claim 1, the inhalation product having an insertable filter unit comprising a tobacco industry product, wherein the insertable filter unit comprises an outer casing defining a cavity for storing the tobacco industry product, wherein the outer casing comprises a receiving portion and an insertion portion, wherein the receiving portion and the insertion portion are mutually engageable parts that, when assembled in an axial direction, define the cavity, wherein the insertable filter unit is arranged to be inserted into the recess of the smoking article filter by a user, and comprises a central portion and end portions either side of the central portion, the diameter of the end portions being smaller than the diameter of the central portion, and wherein the tobacco industry product comprises tobacco, laminar tobacco, a tobacco derivative, expanded tobacco, reconstituted tobacco, inserted in the recess thereof.

9. A kit comprising smoking article filter comprising a recess arranged to accommodate an insertable filter unit according to claim 1, and an insertable filter unit comprising a tobacco industry product, wherein the insertable filter unit comprises an outer casing defining a cavity for storing the tobacco industry product, wherein the outer casing comprises a receiving portion and an insertion portion, wherein the receiving portion and the insertion portion are mutually engageable parts that, when assembled in an axial direction, define the cavity, wherein the insertable filter unit is arranged to be inserted into the recess of the smoking article filter by a user, and comprises a central portion and end portions either side of the central portion, the diameter of the end portions being smaller than the diameter of the central portion, and wherein the tobacco industry product comprises tobacco, laminar tobacco, a tobacco derivative, expanded tobacco, reconstituted tobacco inserted in the recess thereof.

10. A kit according to claim 9, wherein the insertable filter unit of the kit further comprises one or more portions having a first diameter and one or more portions having a second diameter that is smaller than the first diameter, and wherein the one or more portions of the insertable filter unit having the first diameter are to come into contact with a tubular wall of the recess to form a secure fit between the recess and the insertable filter unit.

11. An insertable filter unit according to claim 1, wherein the receiving portion and the insertion portion each comprise a circumferential engaging part that circumferentially engage with each other when assembled.

12. The smoking article filter according to claim 1, comprising a smoking article filter for a cigarette.

13. The smoking article filter according to claim 1, comprising a smoking article filter for a combustible cigarette.

* * * * *